United States Patent [19]

Röck et al.

[11] Patent Number: 4,558,908

[45] Date of Patent: Dec. 17, 1985

[54] PULL-OUT GUIDE ASSEMBLY FOR DRAWERS OR THE LIKE

[75] Inventors: Erich Röck; Josef Brunner, both of Höchst, Austria

[73] Assignee: Julius Blum Gesellschaft m.b.H., Hochst, Austria

[21] Appl. No.: 599,826

[22] Filed: Apr. 13, 1984

[30] Foreign Application Priority Data

May 3, 1983 [AT] Austria ..... 1607/83

[51] Int. Cl.[4] ..... F16C 21/00; A47B 88/00

[52] U.S. Cl. ..... 308/3.8; 308/3.6; 312/330 R

[58] Field of Search ..... 308/3.6, 3.8, 3 R, 3 A; 312/330 R, 339, 341 R

[56] References Cited

U.S. PATENT DOCUMENTS

| | | | |
|---|---|---|---|
| 2,646,333 | 7/1953 | Abrahamson et al. | 308/3.6 X |
| 2,759,773 | 8/1956 | Wilmer | 308/3.6 |
| 3,649,090 | 3/1972 | Dutot | 308/3.6 |
| 3,679,274 | 7/1972 | Nance | 308/3.6 |
| 3,826,554 | 7/1974 | Cornell | 312/330 R |
| 4,045,097 | 8/1977 | Röck et al. | 308/3.8 |
| 4,089,567 | 5/1978 | Röck et al. | 308/3.6 |
| 4,304,449 | 12/1981 | Litchfield et al. | 308/3.6 X |
| 4,367,906 | 1/1983 | Röck | 312/330 R |
| 4,436,357 | 3/1984 | Röck et al. | 312/339 X |

*Primary Examiner*—Stuart S. Levy
*Assistant Examiner*—Thomas R. Hannon
*Attorney, Agent, or Firm*—Wenderoth, Lind & Ponack

[57] ABSTRACT

A pull-out guide assembly for a drawer is mounted below the drawer bottom. Slides are provided for the transmission of load between pull-out rails and supporting rails. The slides have vertical marginal slots in which vertical marginal flanges of the supporting rails are guided to obtain good lateral stability for the drawer. At the front ends of the pull-out rails resilient clamping members are provided which engage in the slides of the supporting rails, when the drawer is in the inserted position.

8 Claims, 8 Drawing Figures

PULL-OUT GUIDE ASSEMBLY FOR DRAWERS OR THE LIKE

FIELD AND BACKGROUND OF THE INVENTION

The invention relates to a pull-out guide assembly for a drawer or the like, in particular for mounting below the level of the bottom of the drawer. The assembly includes, for each side of the drawer, a supporting rail mounted on the side of the furniture body and a pull-out rail mounted on the side of the drawer, the pull-out rail at its rear and the supporting rail at its front being provided with respective slides, and the slides of the pull-out rails embracing the running flanges of the supporting rails, thus holding and preventing the drawer from tilting.

DESCRIPTION OF THE PRIOR ART

Such pull-out guide assemblies in which the load between the rails is transmitted by slides are mainly used with drawers which do not carry heavy loads. Lately, the loading capacity of such pull-out guide assemblies has substantially increased because of new materials for the slides which are able to carry much higher loads, so that such pull-out guide assemblies with slides are employable for a far wider range of uses than in the past.

A problem which generally occurs with pull-out guide assemblies for drawers or shelves, independently of whether the pull-out rails are guided by means of rollers mounted at the rails or by means of roller carriers arranged between the pull-out rails and the supporting rails, is to provide the drawer with satisfactory lateral stability.

SUMMARY OF THE INVENTION

It is the object of the invention to provide a pull-out guide assembly for a drower which ensures lateral stability and in which the pull-out rail rests on the supporting rail by means of slides. When being mounted in the article of furniture, the entire pull-out guide assembly should be fastenable to the body of the article of furniture so that the drawer can be fitted onto the completely mounted pull-out guide assembly and engaged therein.

The latter-mentioned feature is an essential difference with respect to conventional pull-out guide assemblies in which the individual parts of the assembly are separately mounted at the body of the article of furniture, on the one hand, and at the drawer, on the other hand. The pull-out guide assembly according to the invention considers the fact that the drawers are frequently premounted by a manufacturer or that plastic drawers are supplied as injection moulded integral pieces.

The object according to the invention is achieved in that at least one slide has a vertical slot or that one slide side wall together with a vertical flange of the pull-out rail delimits a vertical slot in which a vertical free marginal flange of the supporting rail is guided with lateral stability.

It is advantageously provided that resilient clamping members are provided at the front ends of the pull-out rails which engage the slides of the supporting rails when the drawer is in the fully inserted position. Thus, locking is obtained for the fully inserted drawer.

Advantageously, each clamping member is fitted into an angular portion of the running flange of the pull-out rail, such portion forming a rearwardly open U-shaped member.

A preferred embodiment of the slides located at the front ends of the supporting rails provides that such slides have fastening bolts, for example, which extend downwardly beyond the running flanges of the supporting rails and that the clamping members engage these lower projections.

In this manner, mounting of the slides is facilitated and simultaneously means are provided with which the clamping members can engage when the drawer is shut.

Lateral stability of the pull-out guide assembly and hence of the drawer is substantially increased in one embodiment of the invention by arranging roller carriers between the pull-out rails and the supporting rails, such roller carriers carrying compensating rollers whose rotational axes are vertically aligned and which roll on vertical flanges of the pull-out rails and of the supporting rails.

BRIEF DESCRIPTION OF THE DRAWINGS

Below two embodiments of the invention will be described in more detail with reference to the appended drawings, without limiting the invention to such embodiments, and wherein.

Figure 1:
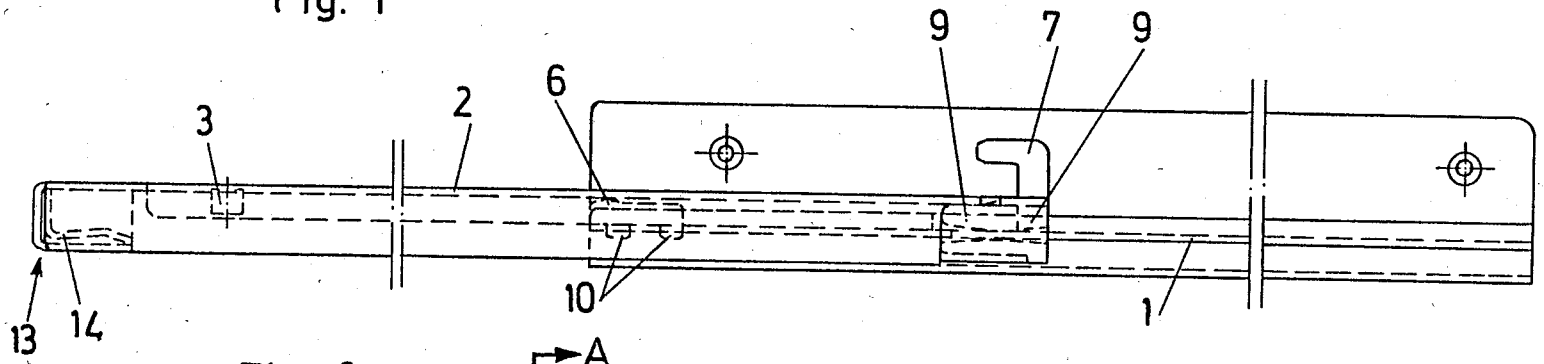
FIG. 1 is a side view of a pull-out assembly in the extracted position, the drawer not being shown.

In the drawings only the pull-out guide assembly of one side is shown. It is obvious that the assembly of the other side is designed as a mirror image. For the purpose of simplicity, reference is made to the illustrated half only in the following description.

DESCRIPTION OF THE PREFERRED EMBODIMENTS

The pull-out guide assembly according to the invention comprises, for each side of an article of furniture a supporting rail 1 mounted on the side of the furniture body and a pull-out rail 2 mounted on the side of the drawer. The pull-out guide assembly according to the invention is advantageously arranged below the bottom 12 of the drawer. The pull-out rail 2 has a flange 2''' abutting on the drawer bottom 12. The supporting rail 1 is advantageously fastened to the body side wall 8.

Figure 2:
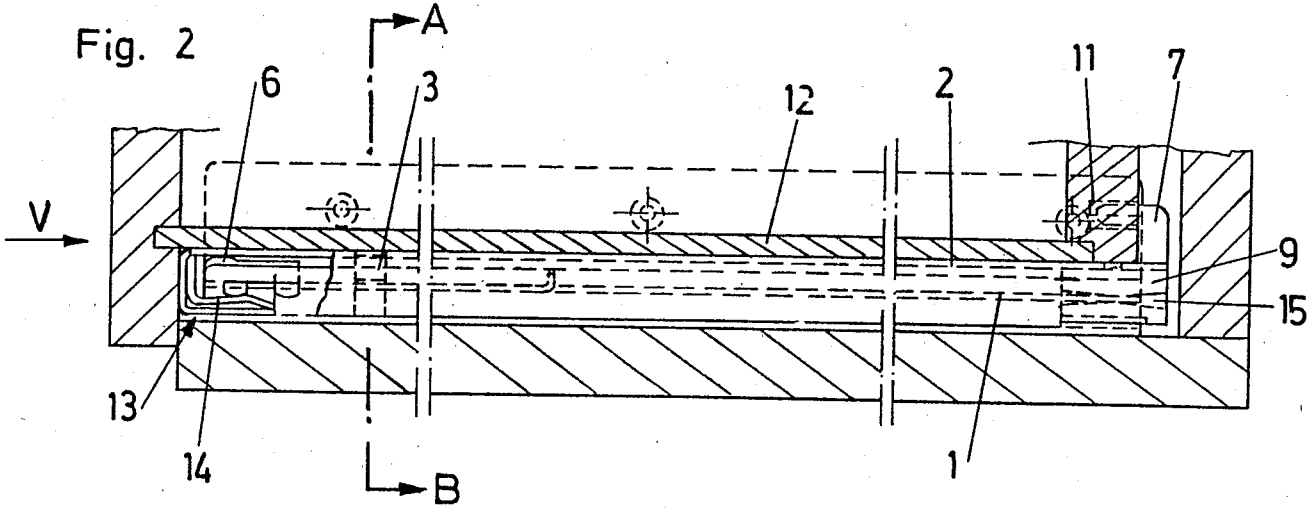
FIG. 2 is a side sectional view of one side of the pull-out guide assembly, with the drawer being shown in the inserted position.
Figure 3:
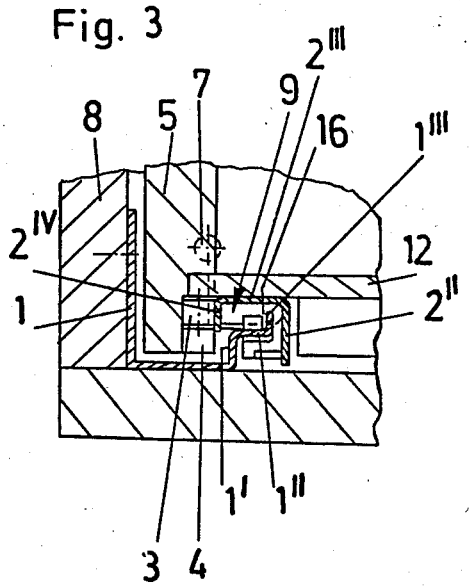
FIG. 3 is a sectional view along line A-B of FIG. 2.
Figure 4:
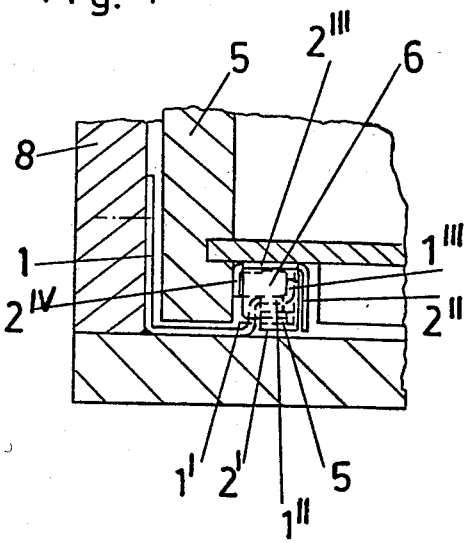
FIG. 4 is an end sectional view in the direction of arrow V of FIG. 2.
Figure 7:
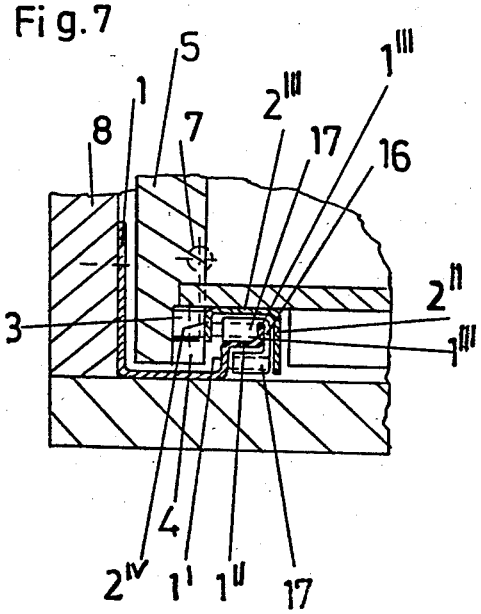
FIGS. 5 to 8 are views analogous to FIGS. 1 to 4 of the second embodiment of the invention.
Figure 8:
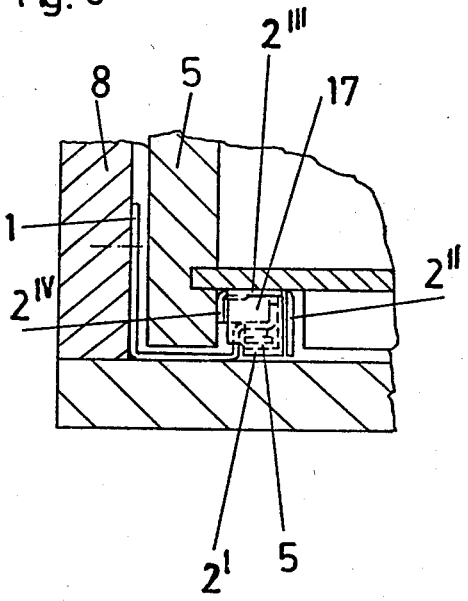
Figure 5:
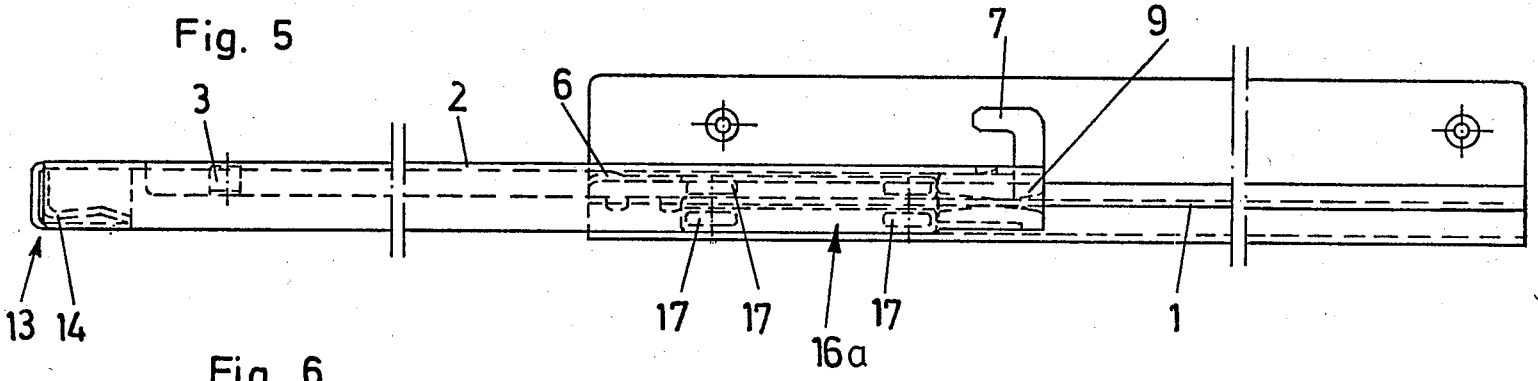

While the supporting rail 1 is screwed to the body side wall 8 in a conventional manner, the pull-out rail 2 is provided at the rear thereof with a hook which is fitted into a hole 11 in the rear wall of the drawer or at the rear end of the drawer side wall 5, as shown in FIG. 2. The front of the pull-out rail 2 is held by means of a positioning sleeve or projection 3 extending into a recess 4 in the drawer side wall 5, as shown in FIG. 3.

As can particularly be seen in FIGS. 3, 4 and 7, 8, the pull-out rail 2 has at the front thereof only a length portion of rectangular cross-section or inverted U-shaped cross-section formed by upper horizontal flange 2''' and opposite vertical flanges 2'' and $2^{IV}$.

A portion of the supporting rail 1 has a Z-shaped profile projecting into the profile of the pull-out rail 2. Such portion is formed by flanges 1', 1'' and 1''' of the supporting rail 1. The central flange 1'' of said portion is a horizontal flange and forms the actual running flange of the supporting rail 1.

A slide 6 is fastened to the front end of the supporting rail 1, and a slide 9 is fastened to the rear end of the pull-out rail 2.

The slide 6 has fastening bolts 10 by means of which slide 6 is fastened onto the horizontal flange 1''. The fastening bolts 10 project through the horizontal flange 1''. At the front end, the pull-out rail 2 has an angular portion 13 which is U-shaped and open towards the rear side. A clamping member 14 is fitted into said angular portion 13.

Figure 6:
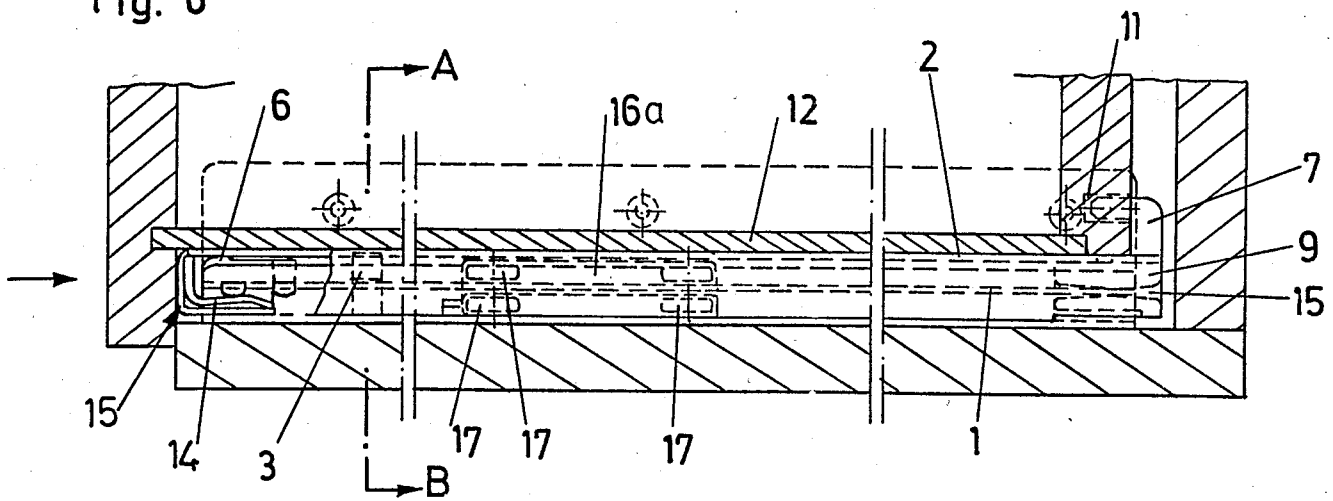

When the drawer is closed, the angular portion 13 embraces the slide 6 by means of the clamping member 14, and the clamping member 14 engages behind the front fastening bolt 10 of the slide 6 (see FIGS. 2 and 6).

The slide 9 at the rear end of the pull-out rail 2 has a horizontal slot 15 and a vertical slot or recess 16 into which fit the flanges 1'' and 1''' of the supporting rail 1, thus holding the drawer on the supporting rail 1 by means of the pull-out rail 2 with lateral stability.

To improve this lateral stability, in the embodiment according to FIGS. 5 to 8 a roller carrier **16*a* is arranged between the supporting rail 1 and the pull-out rail 2, such roller carrier not serving for the transmission of the load of the drower, but exclusively carrying compensation rollers 17 whose axes extend vertically. In the illustrated embodiment, the rollers 17** define the corners of a rectangle.

The compensating rollers 17 of the roller carrier **16*a* are arranged below as well as above the flange 1'' of the supporting rail 1 serving as the running flange for the transmission of load. Upper compensating rollers 17 roll above the flange 1'' between the vertical flange 1''' of the supporting rail 1 and the vertical flange $2^{IV}$ of the pull-out rail 2, and lower compensating rollers 17 roll below the horizontal flange 1'' between the vertical flange 1' of the supporting rail 1 and the vertical flange 2'' of the pull-out rail 2. Together with the slides 6, 9 the compensating rollers 17** effect compact guiding of the drawer in all directions vertically and transversely, i.e. each of the pull-out guide assemblies forms a closed unit which is supported on all sides.

What is claimed is:

1. A pull-out guide assembly for use on each of opposite sides of a drawer in an article of furniture of the type wherein the drawer is sidably insertable into and removable from a furniture body, said assembly comprising:

a supporting rail adapted to be mounted on a side portion of a furniture body, said supporting rail having a horizontal flange and vertical flanges extending from opposite sides of said horizontal flange;

a pull-out rail adapted to be mounted on the bottom of a drawer, said pull-out rail having a horizontal flange and vertical flanges extending from opposite sides of said horizontal flange;

a first slide fixed to a front end of said supporting rail, said horizontal flange of said pull-out rail slidably contacting said first slide;

a second slide fixed to a rear end of said pull-out rail, said second slide embracing said horizontal flange of said supporting rail and thereby preventing tilting of said pull-out rail relative to said supporting rail; and a roller carrier slidably mounted between said supporting and pull-out rails, said roller carrier supporting compensating rollers rotatable about vertical axes and rollingly contacting said vertical flanges of said supporting and pull-out rails.

2. An assembly as claimed in claim 1, wherein said pull-out rail includes means for clamping said first slide when said pull-out rail is in a fully inserted position with respect to said supporting rail.

3. An assembly as claimed in claim 2, wherein said clamping means is at a front end of said pull-out rail.

4. An assembly as claimed in claim 3, wherein said clamping means comprises a clamping member fitted within a rearwardly directed U-shaped portion of said pull-out rail.

5. An assembly as claimed in claim 4, wherein said first slide is fastened to the top of said horizontal flange of said supporting rail by at least one fastener extending through and downwardly below said horizontal flange, and said clamping member engages said fastener in said fully inserted position.

6. An assembly as claimed in claim 1, wherein said second slide has therein a horizontal slot, said horizontal flange of said supporting rail slidably fitting within said horizontal slot.

7. An assembly as claimed in claim 6, wherein said second slide has therein a vertical slot or recess connected with said horizontal slot, and one of said vertical flanges of said supporting rail slidably fitting within said vertical slot or recess.

8. An assembly as claimed in claim 1, wherein said vertical flanges of said pull-out rail extend downwardly from opposite sides of said horizontal flange thereof, a first said vertical flange of said supporting rail extends upwardly from a first side of said horizontal flange thereof, a second said vertical flange of said supporting rail extends downwardly from a second side of said horizontal flange thereof, and said roller carrier includes upper said rollers rollingly contacting a first said vertical flange of said pull-out rail and said first vertical flange of said supporting rail and lower said rollers rollingly contacting a second said vertical flange of said pull-out rail and said second vertical flange of said supporting rail.

* * * * *